US005251350A

United States Patent [19]

Bordenave, Sr. et al.

[11] Patent Number: 5,251,350

[45] Date of Patent: Oct. 12, 1993

[54] INTERCHANGEABLE BEDSPREAD

[76] Inventors: Dallas J. Bordenave, Sr.; Dallas J. Bordenave, Jr., both of 21839 S. Avalon Blvd., #101, Carson, Calif. 90745

[21] Appl. No.: 929,002

[22] Filed: Aug. 13, 1992

[51] Int. Cl.[5] ..... A47G 9/04

[52] U.S. Cl. ..... 5/482; 5/486; 5/502

[58] Field of Search ..... 5/486, 502, 482, 417–420

[56] References Cited

U.S. PATENT DOCUMENTS 2,808,596 10/1957 Schreiner ..... 5/486
3,530,516 9/1970 Marquette ..... 5/486
3,613,133 10/1971 Isola et al. ..... 5/482
4,573,227 3/1986 Prandina ..... 5/486
4,631,765 12/1986 Casey ..... 5/502
4,878,258 11/1989 Casey ..... 5/420
5,070,561 12/1991 Keisder ..... 5/486

FOREIGN PATENT DOCUMENTS 2049414 12/1980 United Kingdom ..... 5/502

*Primary Examiner*—Alexander Grosz
*Attorney, Agent, or Firm*—Robert M. Sperry

[57] ABSTRACT

An improved bedspread comprising a plurality of panels which are each reversible and interchangeable to provide a wide variety of different visual effects.

5 Claims, 4 Drawing Sheets

INTERCHANGEABLE BEDSPREAD

BACKGROUND

1. Field of the Invention

This invention relates to bedspreads and is particularly directed to bedspreads having a plurality of reversible and interchangeable panels which enable the user to provide a wide variety of different decorative effects with a single bedspread.

2. Prior Art

Bedspreads have long been used to protect sheets, blankets and the like from soiling by dust and by people sitting or lying on the bed, aside from normal sleeping usage. At the same time, bedspreads serve a decorative purpose and are frequently the centerpiece of bedroom decor. Unfortunately bedspreads are relatively expensive and, since their uses are subordinate to the primary purpose of a bed, most families have only a very limited number of bedspreads and, consequently, have little or no variety in the appearance of the bedspreads or of the bedroom decor.

In an attempt to solve this limitation, prior art bedspreads have been proposed which are reversible and have a first surface having one color or pattern and a reverse surface having a different color or pattern. This allows the user a choice of two colors or patterns, but cannot provide additional colors or patterns beyond these two. In addition, bed coverings have been proposed having insertable panels to enable the user to change the size of a blanket or bedspread, so that a given blanket could be made to fit a single, double or king-size beds. Other prior art bed coverings have had insertable panels which would allow the user to vary the warmth provided by a given blanket or quilt. However, these devices serve to vary the utility of the bed covering, but do little, if anything, to vary the aesthetic appeal of the bed covering. A search in the United States Patent Office has revealed the following:

| U.S. Pat. No. | INVENTOR | ISSUED |
|---|---|---|
| 4,069,526 | T. Delkel | Jan. 24, 1978 |
| 4,839,934 | R. R. Rojas | Jun. 20, 1989 |
| 4,573,227 | A. F. Prandino | Mar. 4, 1986 |
| 3,508,285 | E. R. T. Marquette | Apr. 28, 1970 |

Each of these references is subject to the limitations discussed above. Thus, none of the prior art bed coverings have been entirely satisfactory.

BRIEF SUMMARY AND OBJECTS OF INVENTION

These disadvantages of prior art bed coverings are overcome with the present invention and an improved bed covering is provided which enables the user to provide a wide variety of different visual effects with a single bedspread and, thereby, to allow considerable variation of the bedroom decor.

The advantages of the present invention are preferably attained by providing a bedspread having a plurality of panels which are each reversible and interchangeable to provide a wide variety of different visual effects.

Accordingly, it is an object of the present invention to provide an improved bedspread.

Another object of the present invention is to provide an improved bedspread which enables the user to significantly alter the bedroom decor, while avoiding the expense of providing a plurality of bedspreads.

An additional object of the present invention is to provide an improved bedspread which provides the user with a wide variety of different colors and patterns, while avoiding the expense of providing a plurality of bedspreads.

A specific object of the present invention is to provide an improved bedspread comprising a plurality of panels which are each reversible and interchangeable to provide a wide variety of different visual effects. Additional panels of the same size, but of different colors, patterns, textures, etc. may be used interchangeably to create an even larger selection of bedspread varieties These and other objects and features of the present invention will be apparent from the following detailed description, taken with reference to the figures of the accompanying drawing.

DETAILED DESCRIPTION OF THE INVENTION

Figure 1:
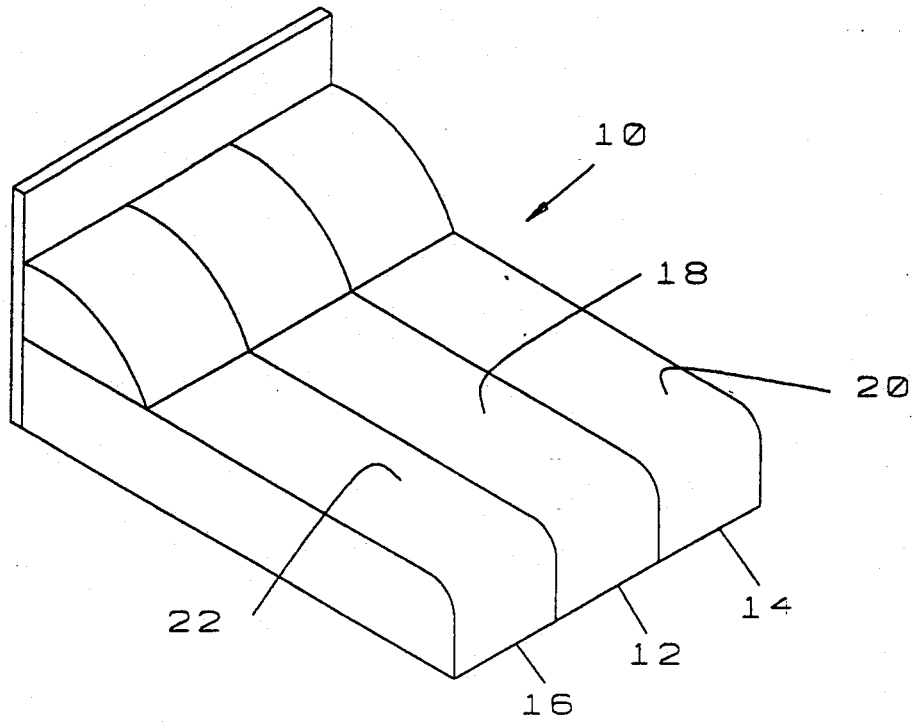
FIG. 1 is a top view of a bedspread embodying the present invention.
Figure 7:
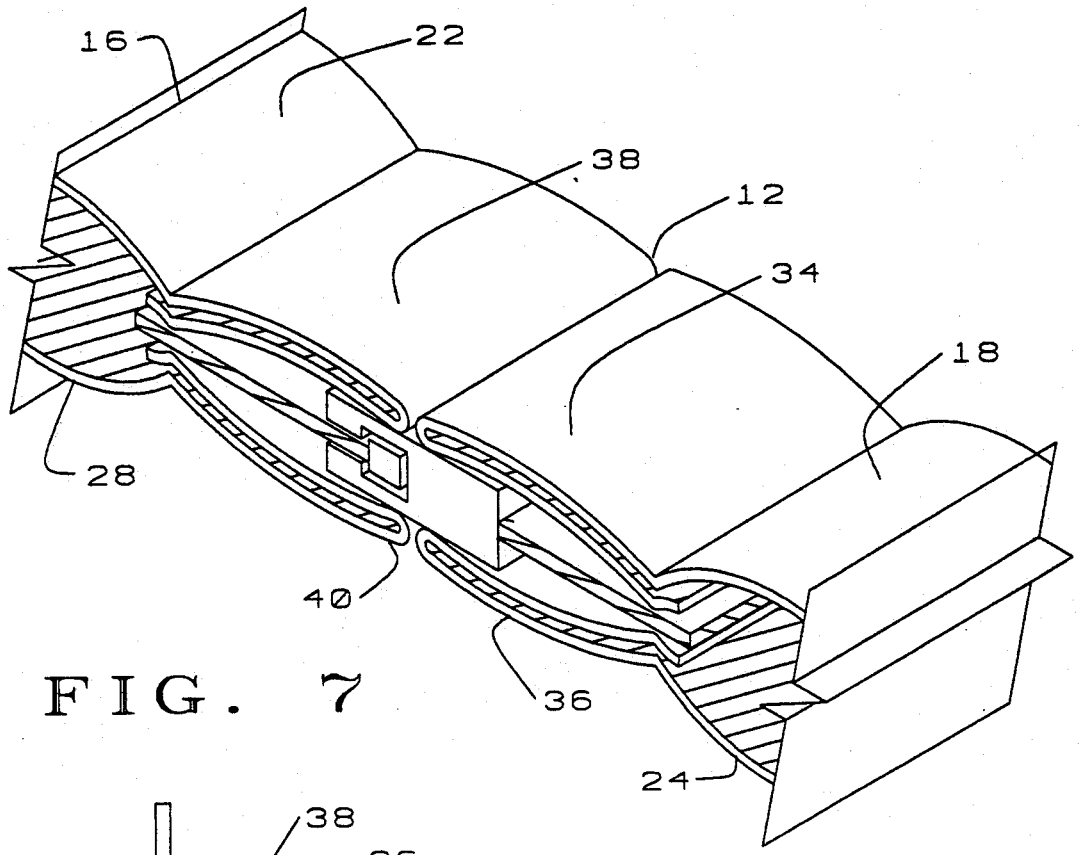
FIG. 7 is an enlarged detail view, partly in section, taken through the overlapping edges of adjacent panels of the bedspread of FIG. 1.

In that form of the present invention chosen for purposes of illustration in the drawing, FIG. 1 shows a bedspread, indicated generally at 10, having a central panel 12 and a pair of side panels 14 and 16. Each of the panels 12, 14 and 16 have first surfaces, as seen at 18, 20 and 22 in FIG. 1, which present first decorative effects, due to the color, pattern, texture, etc. of the first surfaces 18, 20 and 22, and have second surfaces, as seen at 24, 26 and 28 in FIG. 2, which present second decorative effects, which are different from those of the first surfaces 18, 20 and 22 of FIG. 1. The side panels 14 and 16 are separably connected to the central panel 12 by releasable connecting means 32, such as snaps, slide fasteners, strips of hook-and-loop material and the like, as seen in FIG. 7. Also, the central panel 12 is preferably provided with flaps 34 and 36 and the side panels 14 and 16 are provided with flaps 38 and 40, which lie above and below the connecting means 32, to prevent the connecting means 32 from being seen when the bedspread 10 is in use.

Figure 2:
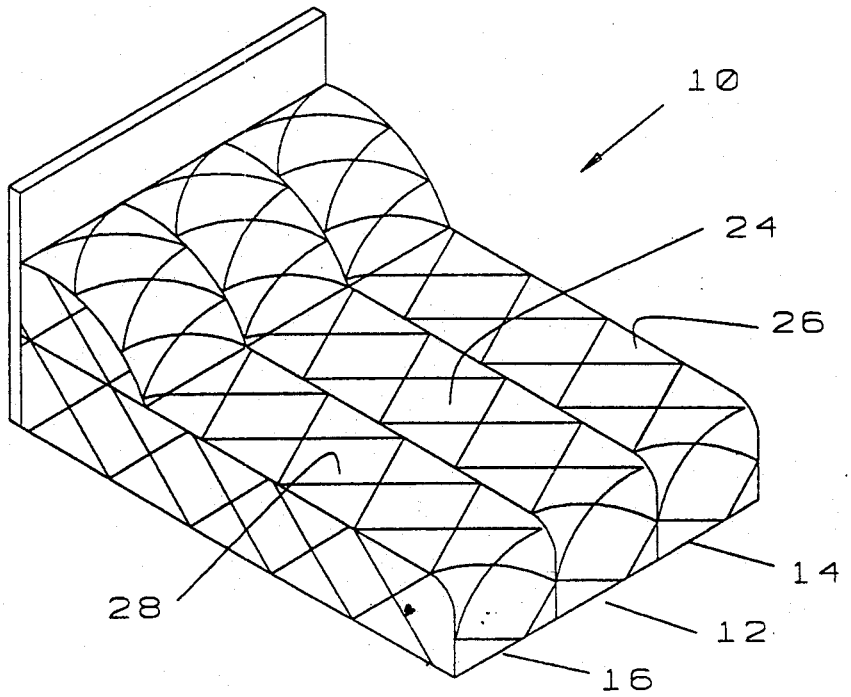
FIG. 2 is a view of the bedspread of FIG. 1 having the reverse side upward.
Figure 3:
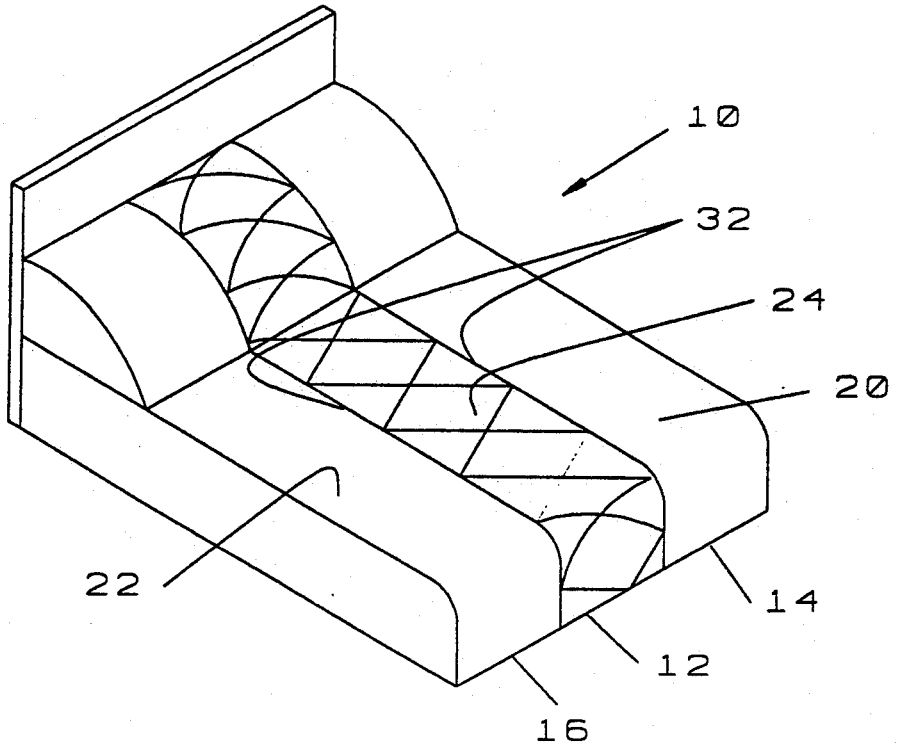
FIG. 3 is a view of the bedspread of FIG. 1 with only the center panel reversed.
Figure 4:
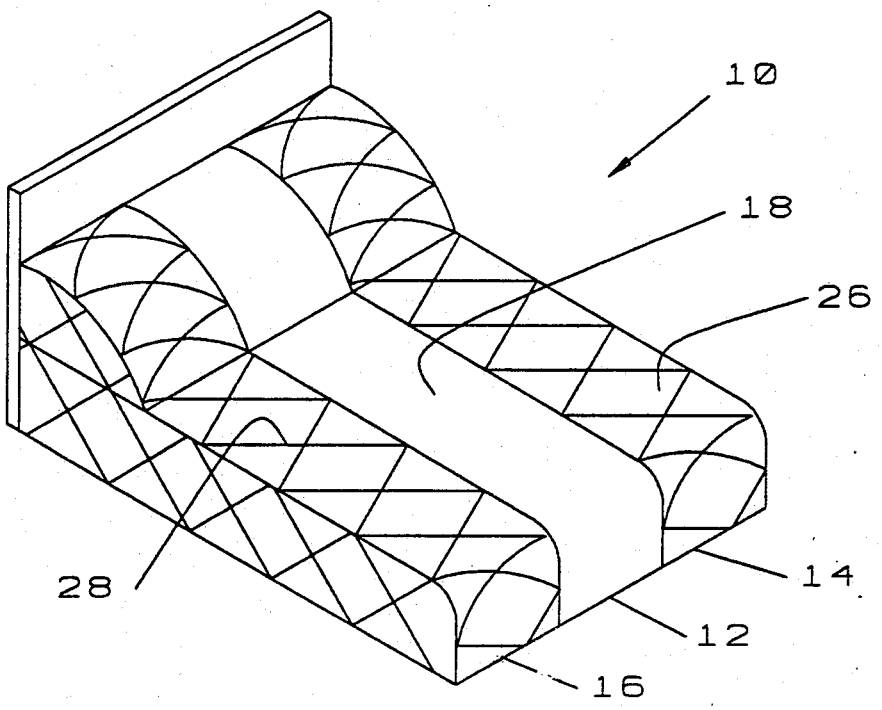
FIG. 4 is a view of the bedspread of FIG. 1 with only the side panels reversed.

When the bedspread 10 is spread over the bed with surfaces 18, 20 and 22 of the panels 12, 14 and 16 to face upward, the bedspread 10 presents a first decorative effect, as seen in FIG. 1. When the bedspread is reversed, to cause the surfaces 24, 26 and 28 of panels 12, 14 and 16 to face upward, a second decorative effect is presented, as seen in FIG. 2. Moreover, releasing the connecting means 32 and reconnecting the center panel 12 with surface 24 facing upward, while surfaces 20 and 22 of the side panels 14 and 16 face upward, serves to produce a third decorative effect, as seen in FIG. 3. Similarly, by placing the center panel 12, with surface 18 facing upward, and connecting the side panels 14 and 16 with surfaces 26 and 28 facing upward, creates a fourth decorative effect, as seen in FIG. 4, which is the reverse of the bedspread of FIG. 3.

Figure 5:
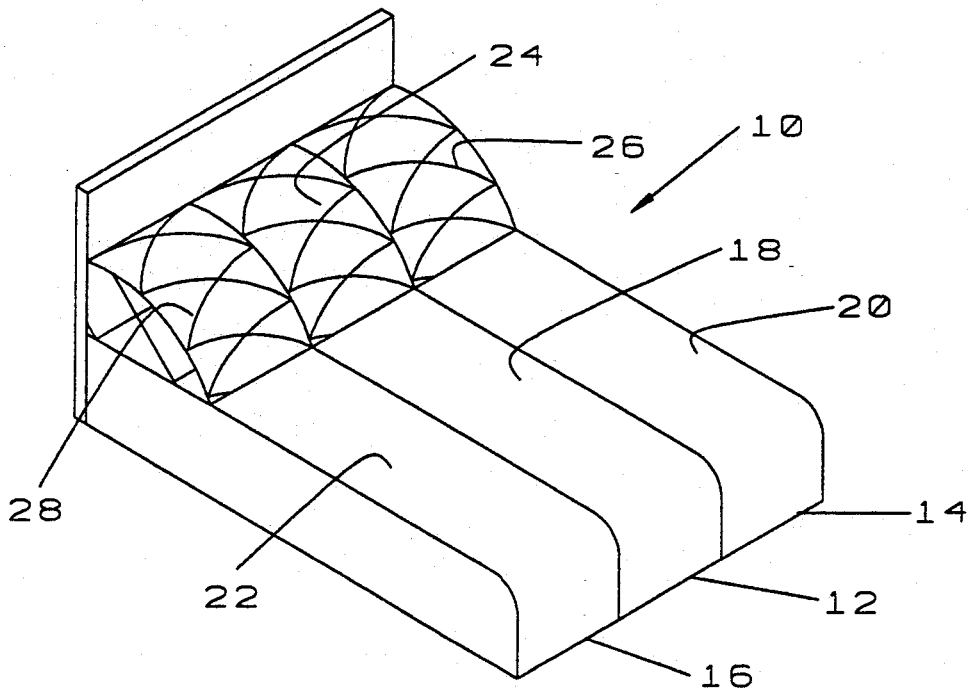
FIG. 5 is a view of the bedspread of FIG. 1 with a portion of the bedspread reversely turned to provide an additional visual difference.
Figure 6:
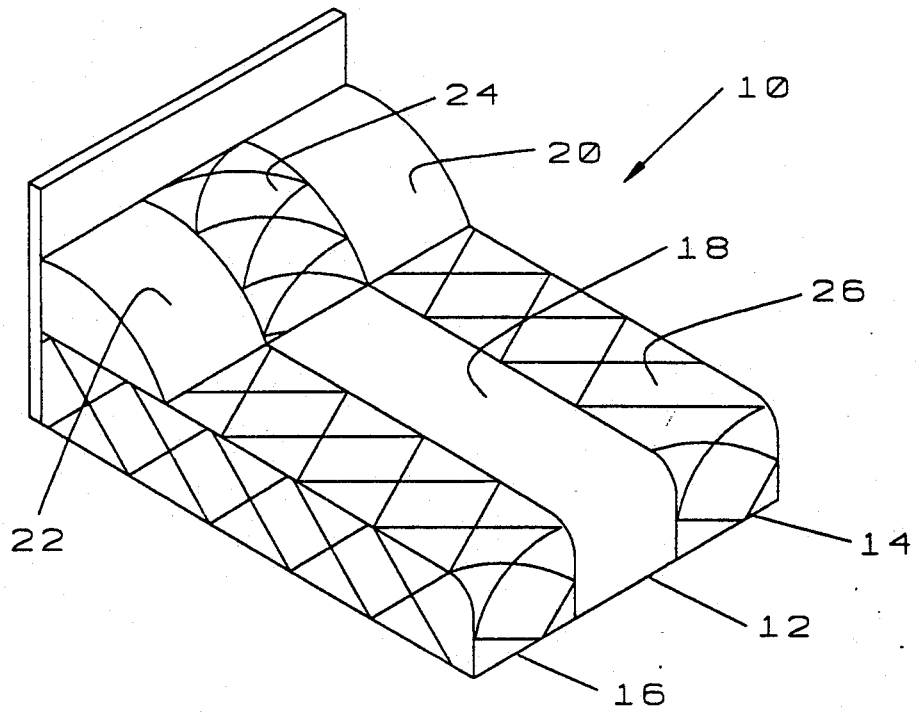
FIG. 6 is a view of the bedspread of FIG. 4 with a portion of the bedspread reversely turned to provide an additional visual difference.
Figure 8:
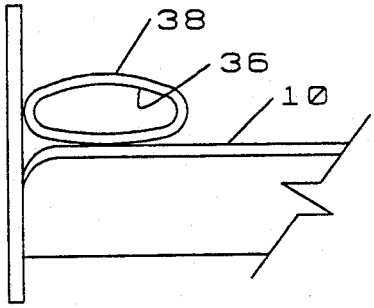
FIG. 8 is a diagrammatic representation showing a first method of covering a pillow with the bedspread of FIG. 1.
Figure 9:
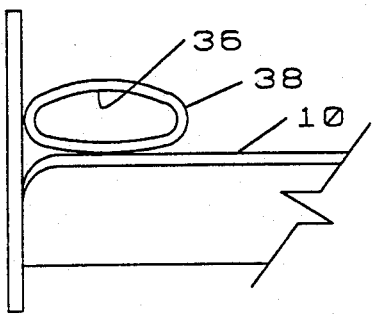
FIG. 9 is a view, similar to that of FIG. 8, showing an alternative method of covering a pillow with the bedspread of FIG. 1.
Figure 1:
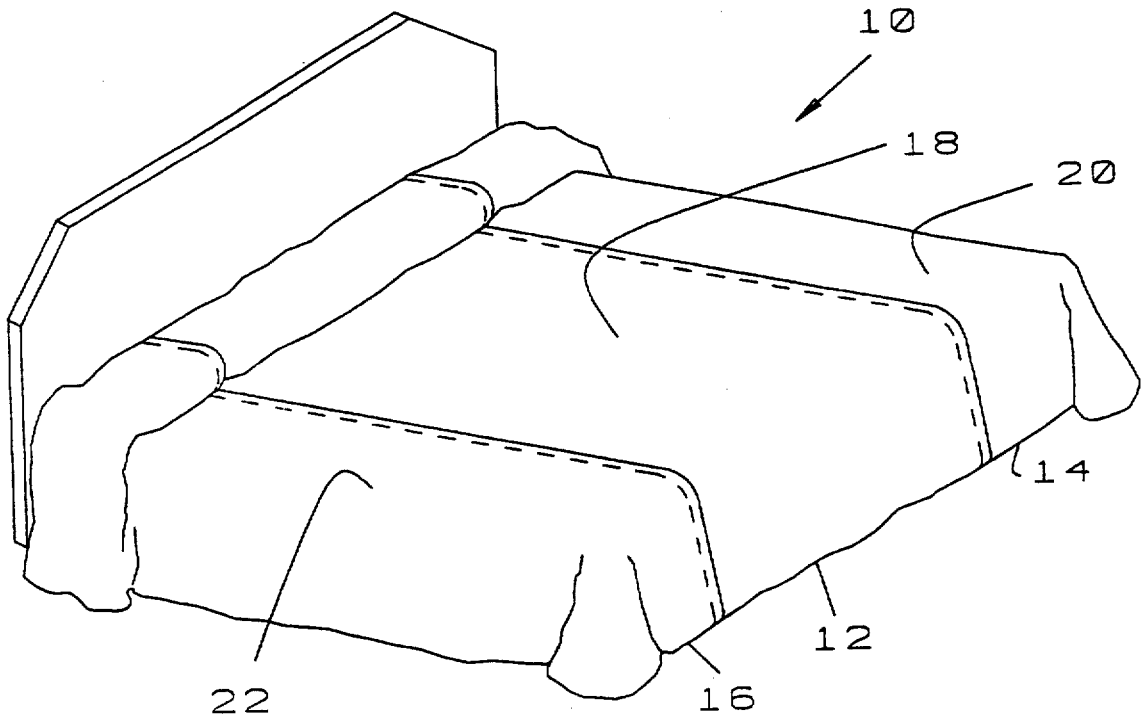
Figure 2:
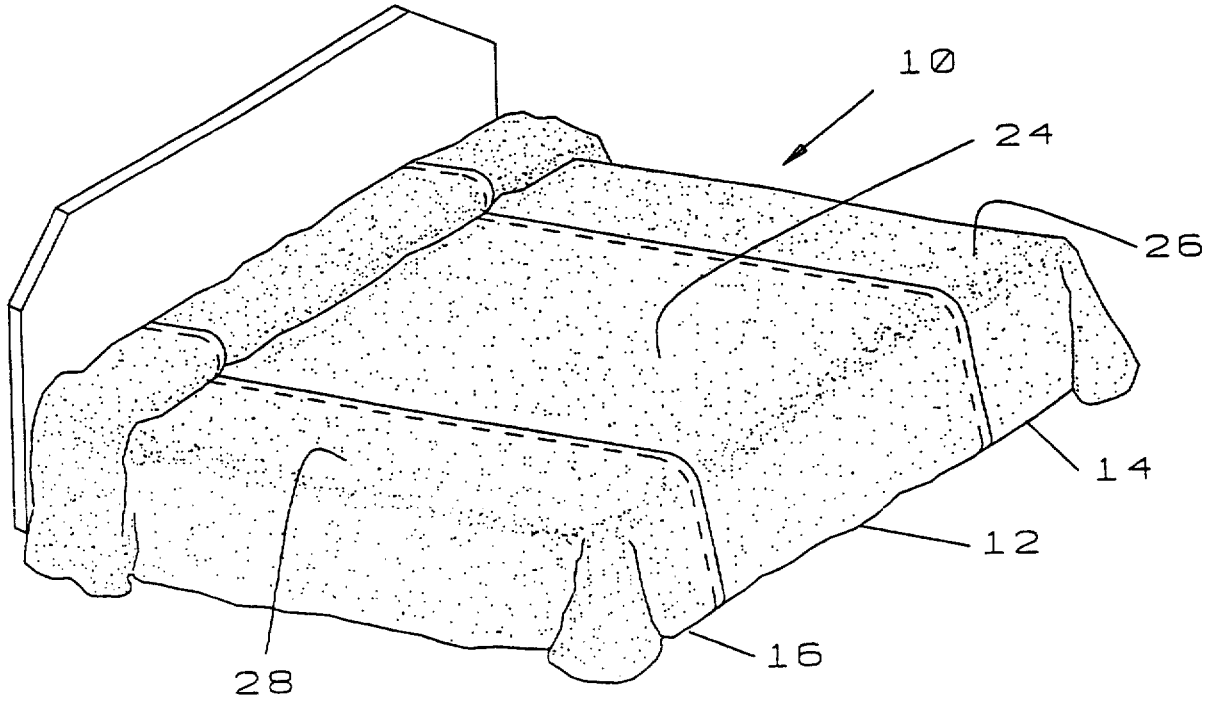
Figure 3:
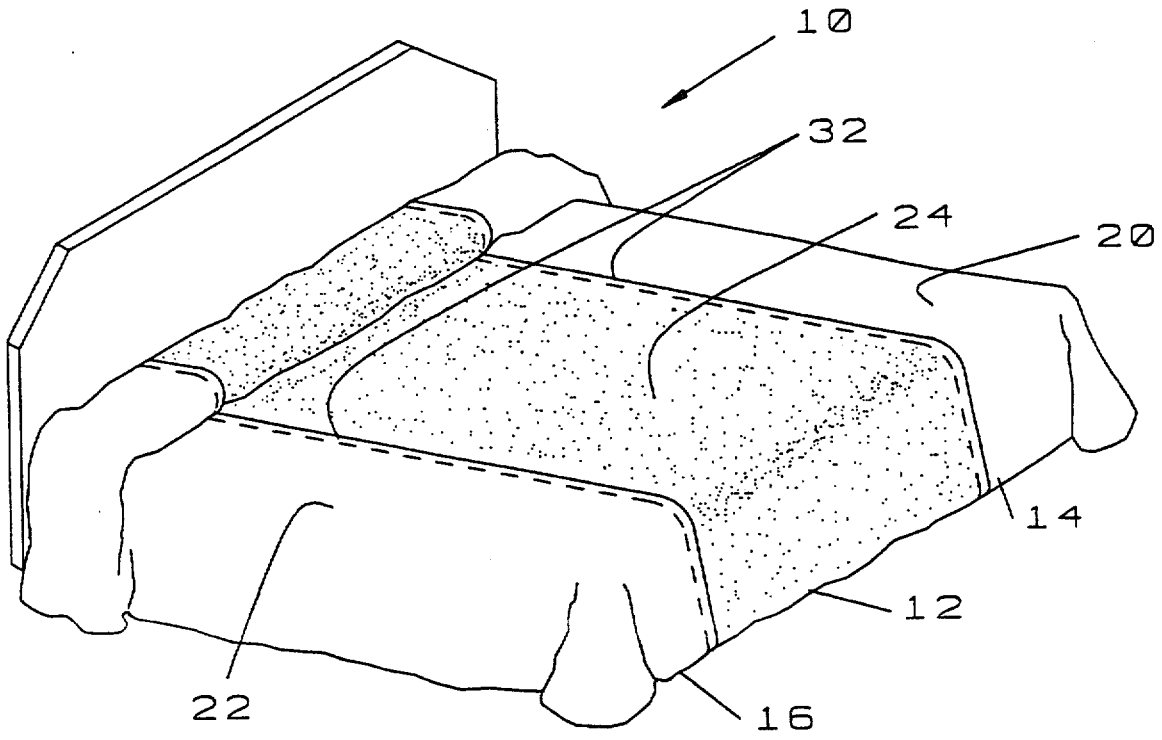
Figure 4:
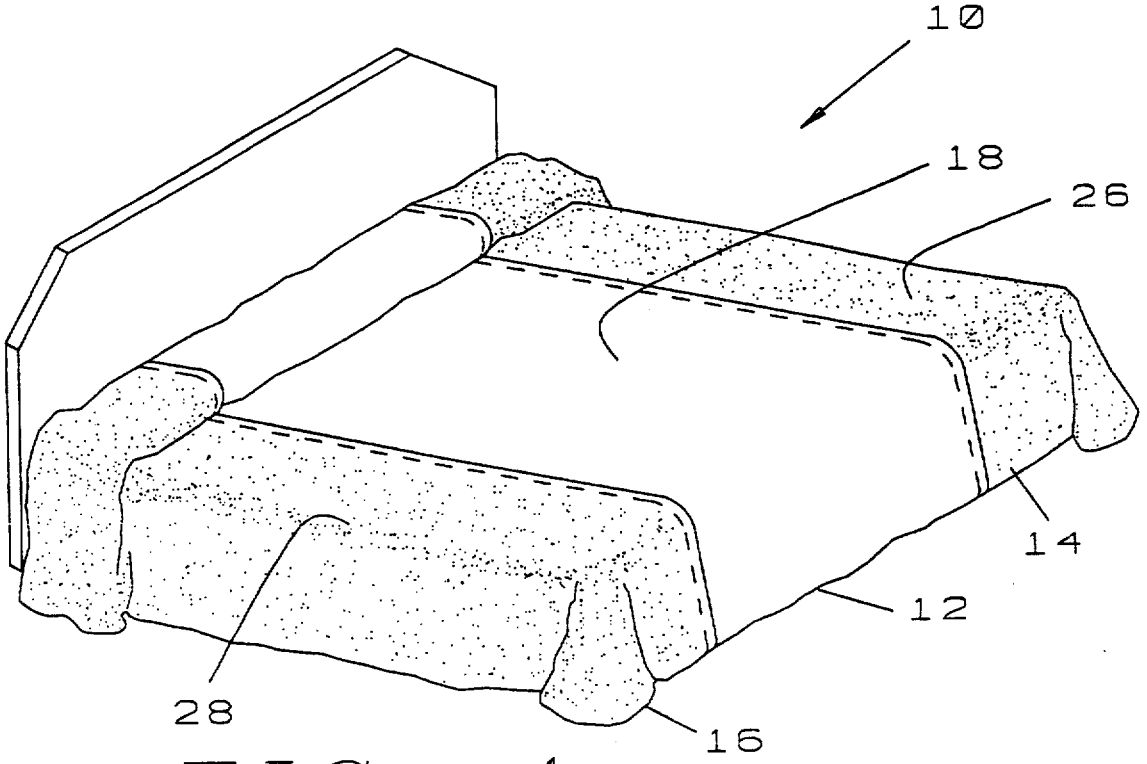
Figure 5:
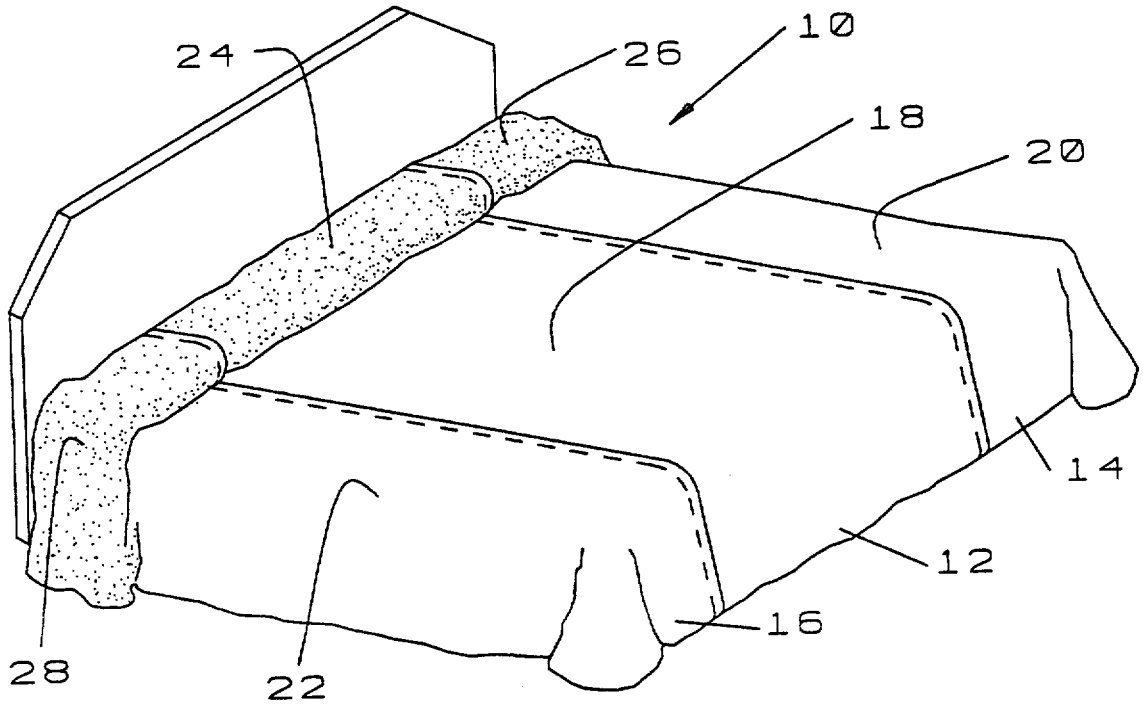
Figure 6:
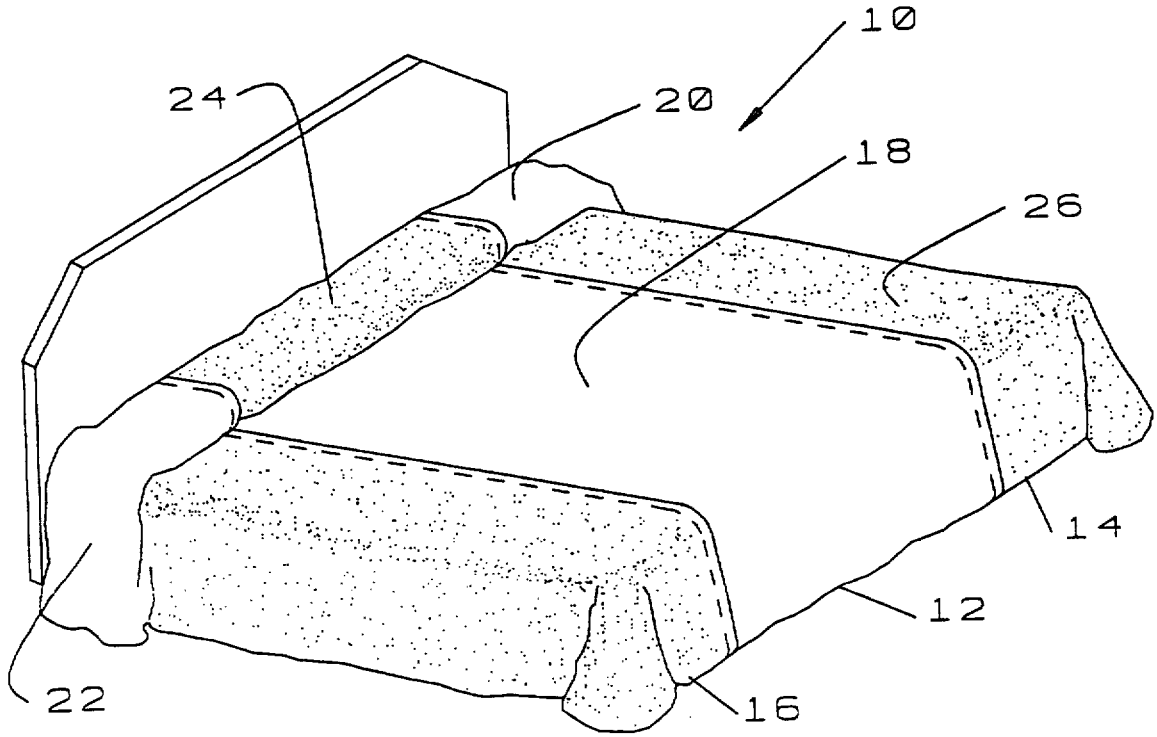
Figure 7:
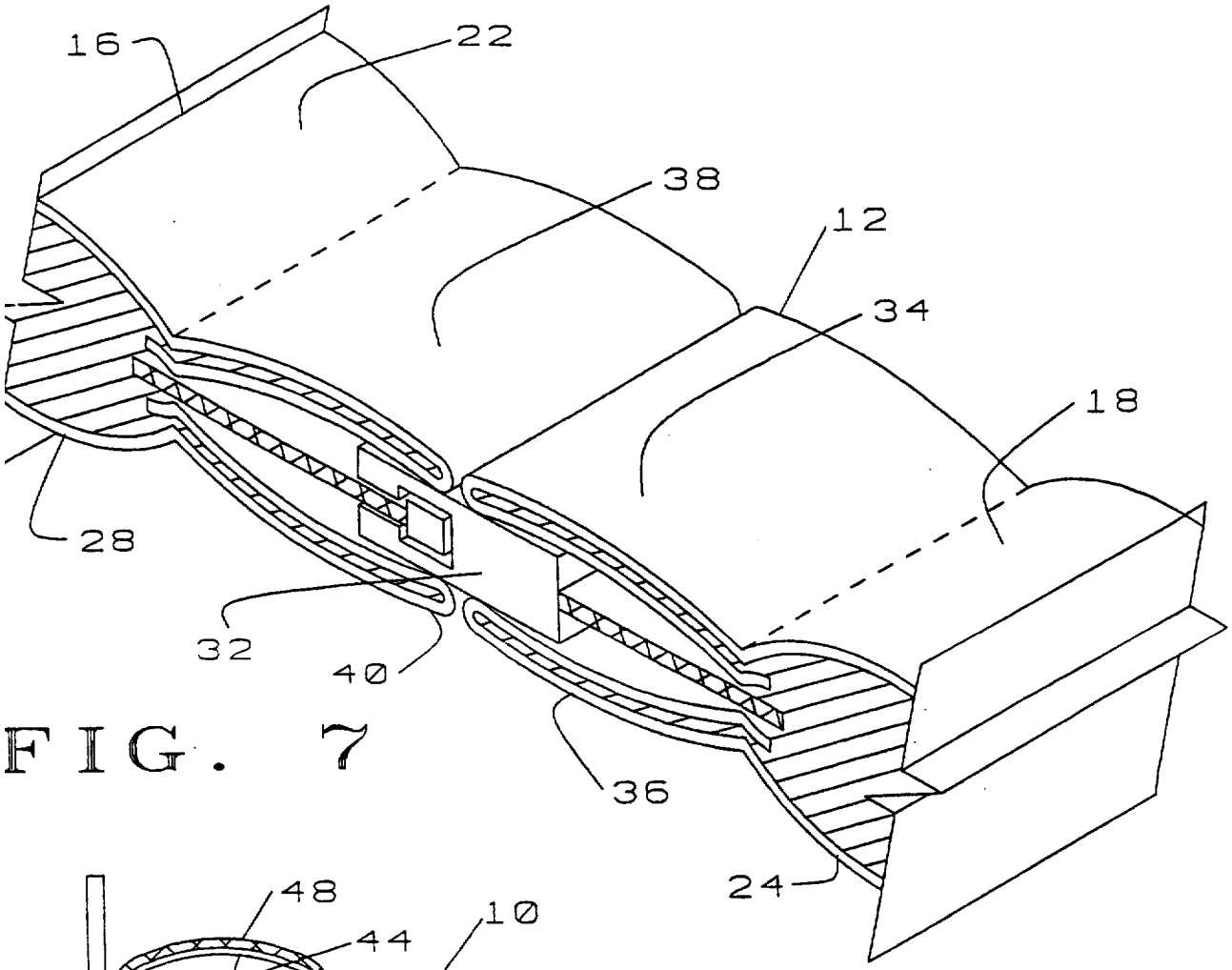
Figure 8:
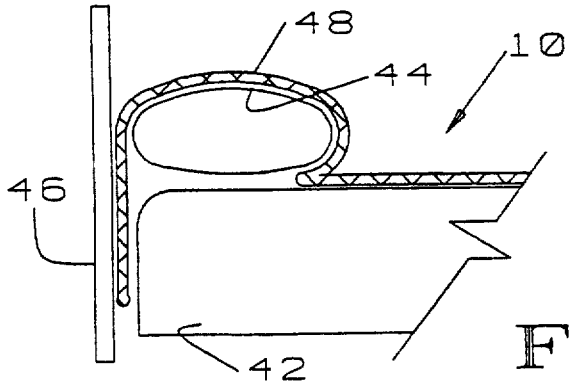
Figure 9:
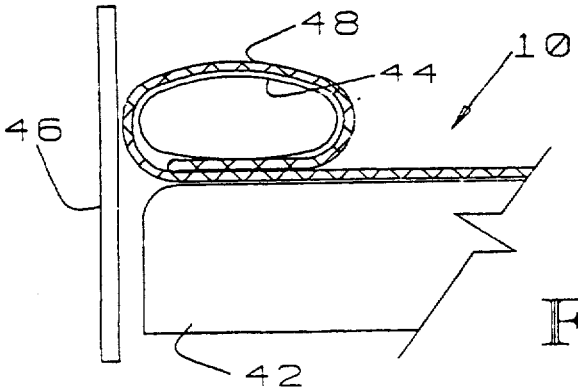

Furthermore, it is conventional to place pillows 44 or the like across the head of a bed and to cover the pillows 44 with the bedspread by laying the end 48 of the bedspread over the pillows 44, in the manner seen in FIG. 8. This arrangement is seen in FIGS. 1, 2, 3 and 4 and, depending on the orientation of the panels 12, 14 and 16, produces the decorative effects seen in a respective one of these figures. However, in accordance with the present invention, the bedspread 10 is made somewhat longer than conventional bedspreads. This has no unique effect when the bedspread is laid over the bed in the manner seen in FIG. 8. However, due to the extra length of the bedspread 10, it is also possible to lay the bedspread 10 on the bed, place the pillows 44 on top of the bedspread 10 and to bring end 48 of the bedspread 10 back over the pillows 44, as seen in FIG. 9. With the bedspread 10 oriented in the manner of FIG. 1, with surfaces 18, 20 and 22 of panels 12, 14 and 16 facing upward, causing the top end 48 of the bedspread 10 to be reversed over the pillows 44, as seen in FIG. 9, will create a fifth decorative effect, as seen in FIG. 5. Similarly, with bedspread 10 oriented in the manner of FIG. 4, with surfaces 18, 26 and 28 of panels 12, 14 and 16 facing upward, causing top end 48 of the bedspread 10 to be reversed over the pillows 44, as seen in FIG. 9, will create a sixth decorative effect, as seen in FIG. 6. It will be apparent that orienting the bedspread 10 in the manner of FIGS. 2 and 3 and causing topend 48 of the bedspread 10 to be reversed over the pillows 44 will create seventh and eighth decorative effects, respectively.

Thus, a single bedspread 10, embodying the present invention, is capable of use to create eight different decorative effects. Moreover, additional panels could be provided, corresponding to central panel 12 and side panels 14 and 16, but having still different upper and lower decorative surfaces, and these additional panels could be interchanged with the original panels to create further decorative effects. In addition, numerous other variations and modifications can, obviously, be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A bedspread comprising: a plurality of panels, each having an edge and formed with a first surface providing a first decorative effect and a second surface providing a second decorative effect and releasable fastening means connecting adjacent edges of said panels and extending along the entire length of said edges, portions of said first and second surfaces extending beyond the edge of said panel in continuous planes above and below said fastening means to cover said fastening means in a manner to cause said fastening means to be substantially invisible.

2. The bedspread of claim 1 wherein:

said plurality of panels includes at least one central panel and at least two side panels.

3. The bedspread of claim 1 wherein:

any one of said panels may be reversibly connected to an adjoining panel.

4. The bedspread of claim 1 wherein:

said panels are interchangeably connected to form said bedspread.

5. The bedspread of claim 1 further comprising:

at least one additional panel interchangeably connectable to replace a desired one of said plurality of panels and having surfaces providing different from those of said first and second surfaces.

* * * * *

UNITED STATES PATENT AND TRADEMARK OFFICE

CERTIFICATE OF CORRECTION

PATENT NO. : 5,251,350

DATED : October 12, 1993

INVENTOR(S) : Dallas J. Bordenave, et. al.

It is certified that error appears in the above-indentified patent and that said Letters Patent is hereby corrected as shown below:

The title page showing the illustrative figure should be deleted to be replaced with the attached title page.

Drawing sheets, consisting of Figs. 1-9, should be deleted to be replaced with the Drawing Sheets, consisting of Figs. 1-9, as shown on the attached page.

Signed and Sealed this

Seventh Day of March, 1995

Bruce Lehman

*Attest:*

BRUCE LEHMAN

*Commissioner of Patents and Trademarks*

*Attesting Officer*

United States Patent [19]

Bordenave, Sr. et al.

[11] Patent Number: 5,251,350

[45] Date of Patent: Oct. 12, 1993

[54] INTERCHANGEABLE BEDSPREAD

[76] Inventors: Dallas J. Bordenave, Sr.; Dallas J. Bordenave, Jr., both of 21839 S. Avalon Blvd., #101, Carson, Calif. 90745

[21] Appl. No.: 929,002

[22] Filed: Aug. 13, 1992

[51] Int. Cl.[5] ..... A47G 9/04

[52] U.S. Cl. ..... 5/482; 5/486; 5/502

[58] Field of Search ..... 5/486, 502, 482, 417–420

[56] References Cited

U.S. PATENT DOCUMENTS

| | | | |
|---|---|---|---|
| 2,808,596 | 10/1957 | Schreiner | 5/486 |
| 3,530,516 | 9/1970 | Marquette | 5/486 |
| 3,613,133 | 10/1971 | Isola et al. | 5/482 |
| 4,573,227 | 3/1986 | Prandina | 5/486 |
| 4,631,765 | 12/1986 | Casey | 5/502 |
| 4,878,258 | 11/1989 | Casey | 5/420 |
| 5,070,561 | 12/1991 | Keisder | 5/486 |

FOREIGN PATENT DOCUMENTS

| | | | |
|---|---|---|---|
| 2049414 | 12/1980 | United Kingdom | 5/502 |

*Primary Examiner*—Alexander Grosz

*Attorney, Agent, or Firm*—Robert M. Sperry

[57] ABSTRACT

An improved bedspread comprising a plurality of panels which are each reversible and interchangeable to provide a wide variety of different visual effects.

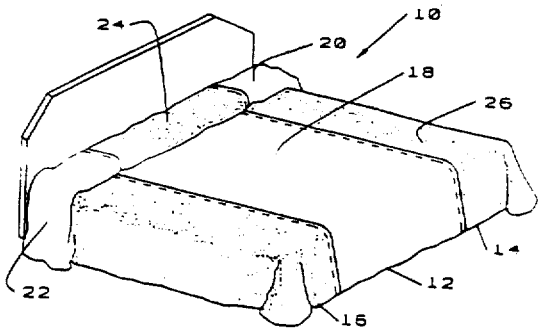

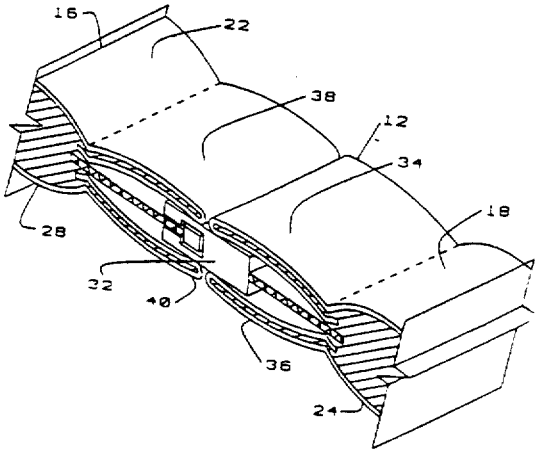

5 Claims, 4 Drawing Sheets